United States Patent [19]

Symons et al.

[11] Patent Number: 4,931,694

[45] Date of Patent: Jun. 5, 1990

[54] COUPLED CAVITY CIRCUIT WITH INCREASED IRIS RESONANT FREQUENCY

[75] Inventors: Robert S. Symons, Los Altos; Mark F. Kirshner, San Francisco, both of Calif.

[73] Assignee: Litton Systems, Inc., Beverly Hills, Calif.

[21] Appl. No.: 201,560

[22] Filed: Jun. 1, 1988

[51] Int. Cl.[5] ..... H01J 25/34

[52] U.S. Cl. ..... 315/3.5; 315/39.3; 330/43

[58] Field of Search ..... 315/5.39, 5.35, 5.43, 315/5.51, 5.41, 5.46, 5.53, 3.5, 3.6, 39.3; 330/43, 45; 333/156; 331/82, 83

[56] References Cited

U.S. PATENT DOCUMENTS

| | | | |
|---|---|---|---|
| 3,011,085 | 11/1961 | Caldwell, Jr. | 315/3.5 |
| 3,233,139 | 2/1966 | Chodorow | 330/43 |
| 3,289,031 | 11/1966 | Hiramatsu et al. | 315/39.3 |
| 3,989,978 | 11/1976 | Samseng et al. | 315/3.5 |
| 4,156,163 | 5/1979 | Harper et al. | 315/3.5 |
| 4,284,922 | 8/1981 | Perring et al. | 315/5.39 |
| 4,746,833 | 5/1988 | King et al. | 315/3.5 |

OTHER PUBLICATIONS

T. Wessel-Berg, "A General Theory of Klystrons with Arbitrary, Extended Interaction Fields," published by Microwave Laboratory, Stanford University, Stanford, California, Technical Report No. 376, Mar. 1987.

M. Chodorow, "A High-Efficiency Klystron with Distributed Interaction," the Transactions on Electron Devices, p. 44, Jan. 1961.

*Primary Examiner*—Eugene R. LaRoche

*Assistant Examiner*—Seung Ham

*Attorney, Agent, or Firm*—Poms, Smith, Lande & Rose

[57] ABSTRACT

A coupled-cavity circuit for a microwave electron tube is shown having one or more cavities whose cross-sections are polygonally shaped, such as rectangles. Located in one or more corners of the polygonally shaped cavities are irises which have a higher resonant frequency. These irises are generally triangularly shaped with rounded corners and one leg of the triangle rounded about the drift tube of the microwave electron tube.

20 Claims, 3 Drawing Sheets

Fig. 1.
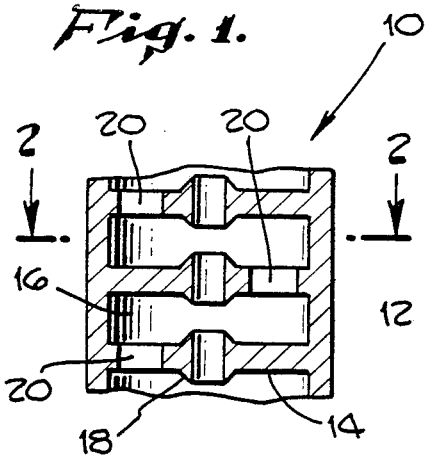
Fig. 3.
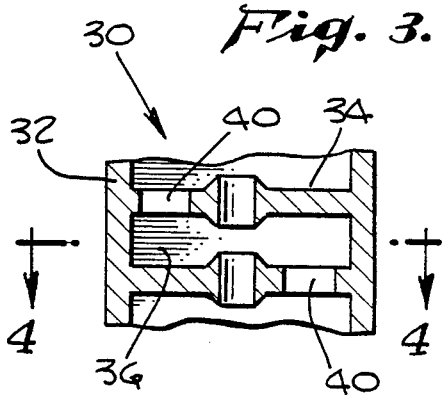
Fig. 2.a
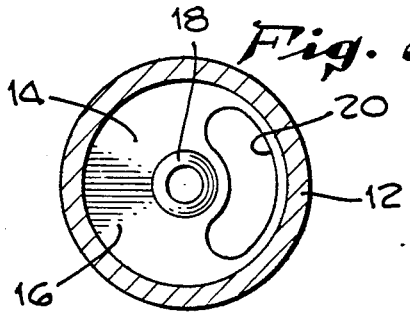
Fig. 4.a
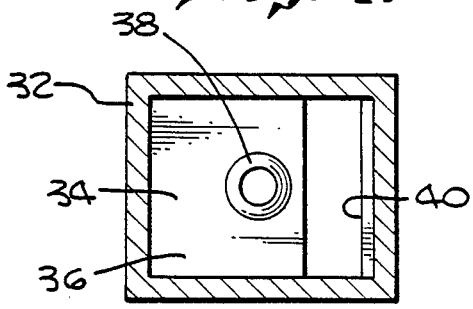
Fig. 2.b
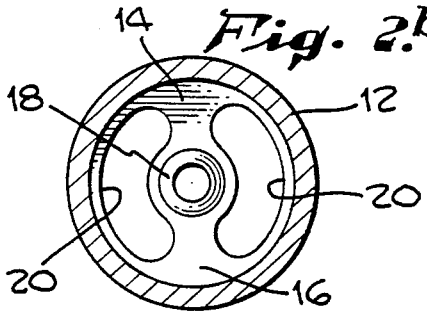
Fig. 4.b
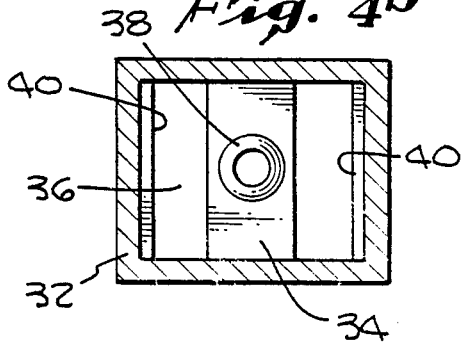
Fig. 2.c
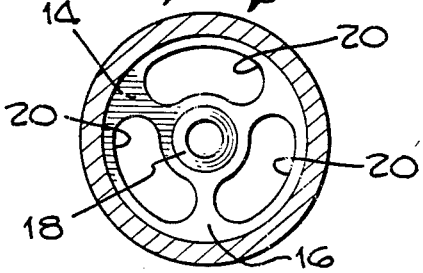

Fig. 8.
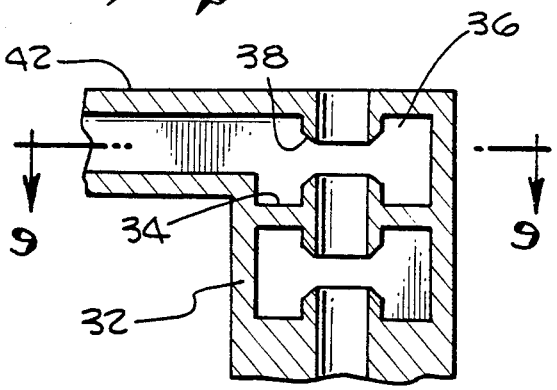
Fig. 10.a
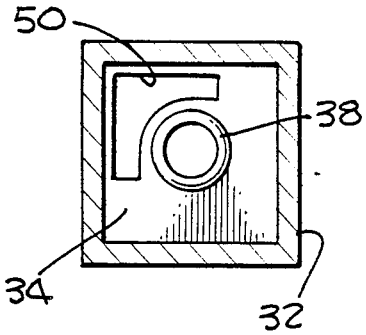
Fig. 9.
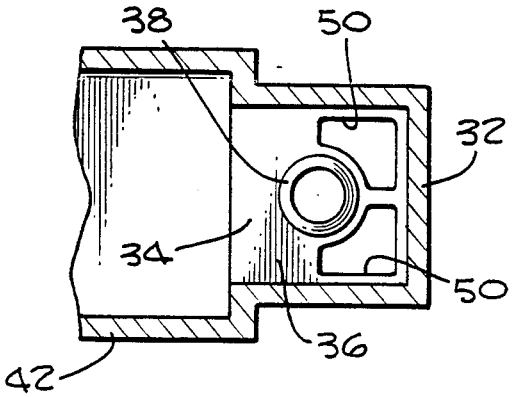
Fig. 10.b
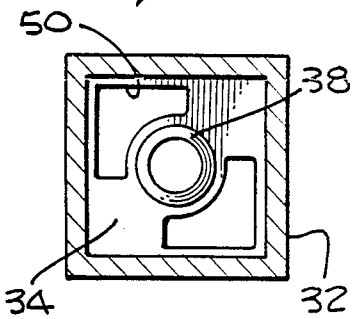
Fig. 10.c
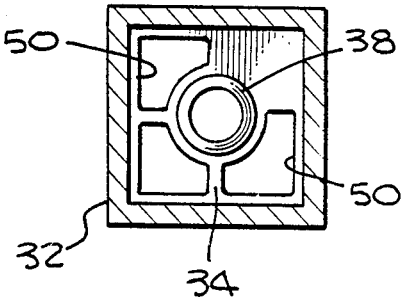
Fig. 10.d
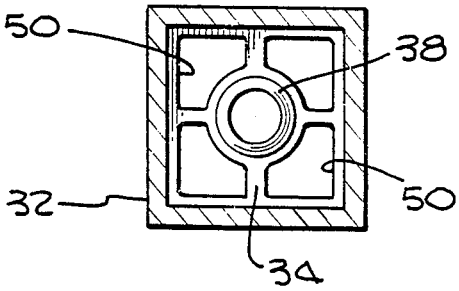

COUPLED CAVITY CIRCUIT WITH INCREASED IRIS RESONANT FREQUENCY

BACKGROUND OF THE INVENTION

1. Field of the Invention:

The present invention relates to coupled cavity circuits that may be utilized in microwave electron tubes such as traveling-wave tubes or klystrons and, more particularly, to an iris configuration utilized within coupled cavity circuits that increases the resonant frequency of the iris.

2. Discussion of the Prior Art:

Microwave electron tubes such as traveling-waves tubes or klystrons are well known in the art. These devices may be designed to operate at ultra-high frequencies or microwave frequencies within a desired bandwidth of such frequencies. The design of the microwave tube to provide the desired bandwidth of frequencies is often based upon a series of cavities through which an electron beam must travel. The electric waves created in the cavities by an electron beam or the external excitation by a low-power radio frequency source act upon the electrons in the beam and cause them to change speed so they arrive at a subsequent cavity in increasingly dense bunches. At the output of the tube, the energy of the electrons is absorbed by the field of an output device to contribute to the function of that device.

A klystron tube, such as an extended interaction klystron, may use two or more cavities coupled by openings or irises between the cavities. Similarly, a traveling-wave tube, such as a coupled-cavity, traveling-wave tube, may use from five to thirty cavities with coupling irises.

A paper describing an extended interaction klystron was written by T. Wessel-Berg, "A General Theory Of Klystrons With Arbitrary, Extended Interaction Fields," Microwave Lab., Stanford University, Stanford, California, Tech. Rept. No. 376; March, 1957. A second paper on the subject was written by M. Chodorow, "A High-Frequency Klystron With Distributed Interaction," The Transactions Of Electron Devices, p. 44, Jan., 1961.

It is desirable to design a microwave electron tube, such as a coupled-cavity, traveling-wave tube or an extended interaction klystron, with as broad a bandwidth of frequency responses as possible.

SUMMARY OF THE INVENTION

Accordingly, it is an object of the present invention to provide a microwave electron tube with an increased bandwidth.

It is a further object of the present invention to provide the microwave tube with a circuit of increased impedance and increased bandwidth.

In accomplishing these and other objects, there is provided a microwave electron tube such as a coupled-cavity, traveling-wave tube or an extended interaction klystron with coupled cavities that are polygonally shaped. Within the polygonal cross-section of each cavity, one or more irises for coupling the cavities is located in one or more corners of the polygon. Each iris may be generally triangular in shape with rounded corners. The location and configuration of the iris achieves a higher resonant frequency for the iris. This permits more bandwidth, lower power loss and higher impedance within the microwave tube.

DESCRIPTION OF THE DRAWINGS

A better understanding of the present invention and of the objects set forth above will be had after careful consideration of the specification and drawings, wherein:

FIG. 1 is a cross-sectional view showing the cavities of a cylindrical microwave electron tube;

FIGS. 2*a*, b and c are cross-sectional views taken along line 2—2 of FIG. 1 showing various crescent shaped irises in the cylindrical cavities of FIG. 1;

FIG. 3 is a cross-sectional view showing the cavities within a rectangular microwave tube;

FIGS. 4*a* and b are cross-sections taken along line 4—4 of FIG. 3 showing rectangularly shaped irises within the rectangular cavity of FIG. 3;

FIG. 8 is a cross-sectional view similar to FIG. 6;

FIG. 9 is a cross-sectional view taken along line 9—9 of FIG. 8; and FIGS. 10*a*, b, c and d are cross-sectional views similar to FIG. 9.

DESCRIPTION OF THE PREFERRED EMBODIMENTS

Figure 5:
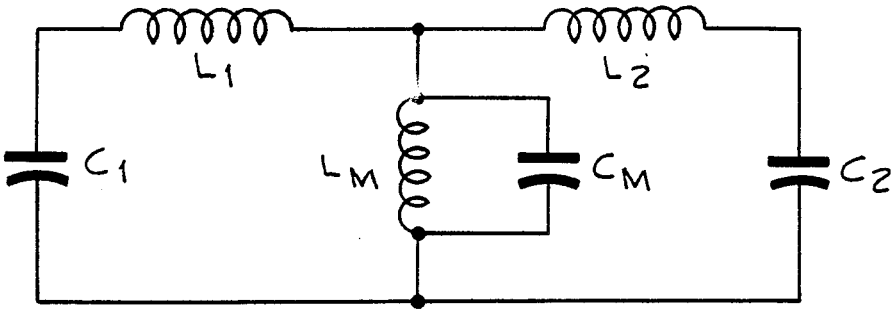
FIG. 5 is an equivalent circuit for two coupled cavities.

Referring now to FIG. 1 of the drawings, a portion of a microwave electron tube 10 is shown in cross-section having cylindrical sidewalls 12 that may be formed in sections and cylindrical cavity plates 14 spaced between the sidewall sections 12 to form cavities 16 therebetween. The center of each of the cavity plates 14 is provided with an aperture that receives a tubular member 18 known as a drift tube which is attached to the plate 14, as by brazing. Sidewalls 12, plates 14 and tubes 18 may be made from various conductive materials. For example, sidewalls 12 may be made from copper; while plates 14 and tubes 18 may be made from copper or from a ferromagnetic material. When the microwave electron tube circuit 10 is placed between a cathode and collector, not shown, a flow of electrons passed through the tubes 18 will create electric fields within the cavities 16 that, in turn, act upon the electron beam.

The frequency band over which electromagnetic energy propagates between the cavities may be adjusted by adjusting the dimensions of the cavities 16 and of irises 20 shown in FIG. 1.

When the microwave electron tube 10 is cylindrically shaped, it is common to form the irises 20 in a crescent shape as shown in FIGS. 2*a*, *b* and *c*. As seen in these figures, the irises 20 may include a single crescent shaped iris, a pair of irises, three irises or other variations.

Referring now to FIG. 3, a microwave electron tube 30 is shown having rectangular sidewalls 32 which may be formed in sections and stacked with rectangular cavity plates 34 therebetween to form a series of cavities 36. Plates 34 are provided with apertures which receive drift tubes 38, as described above. The cavities 36 are again joined by irises 40 which may be used to tune the resonant frequency of tube 30.

As seen in FIGS. 4*a* and *b*, the irises 40 are typically rectangular in shape to correspond with the rectangular shape of cavities 36. It will also be seen that one, two or more cavities 40 may be utilized.

A review of FIGS. 1–4 will disclose that the irises 20 (FIG. 2) or 40 (FIG. 4) may be arranged within each cavity 16 and 36, respectively, so that the irises are in line or staggered from one cavity to the next.

An equivalent circuit for the coupled cavities shown in FIGS. 1–4 may be seen in FIG. 5 which is used to represent a pair of coupled cavities. The capacitors $C_1$ and $C_2$ represent the capacitances of the gaps between drift tubes 18 or 38 in the two resonant cavities 16 or 36 which interact with the electron beam passing through drift tubes 18 or 38. The inductances $L_1$ and $L_2$ represent the uncoupled cavity inductances. The inductance $L_M$ is the mutual inductance or the equivalent inductance of the iris 20 or 40 between the cavities. The capacitance $C_M$ is the mutual capacitance or the equivalent capacitance of the iris. $L_M$ and $C_M$ have a resonant $f_i = \frac{1}{2}\pi\sqrt{L_M C_M}$ which has an effect on the performance of the equivalent circuit very similar to the effect of the iris resonant frequency on the performance of the pair of coupled cavities. In general, a low resonant frequency $f_i$ of the iris is deleterious.

It will be understood that what is desired is to have a very high frequency of the iris so that the iris does not interfere with the frequency of the microwave electron tube. One way of understanding this is to realize that the capacitance of the iris reduces the mutual reactance below that which would exist if only the coupling inductances were present and thus reduces the coupling between the two resonators and narrows the bandwidth of a circuit incorporating such cavities. Another way of looking at the effect of the iris capacitance, or in other words a finite iris resonant frequency $f_i$, is to realize that the iris capacitance must store energy in the form of electric fields which do not interact with the electron beam and therefore must reduce the impedance-bandwidth product of the circuit below that of a circuit in which the capacitance is less.

Figure 6:
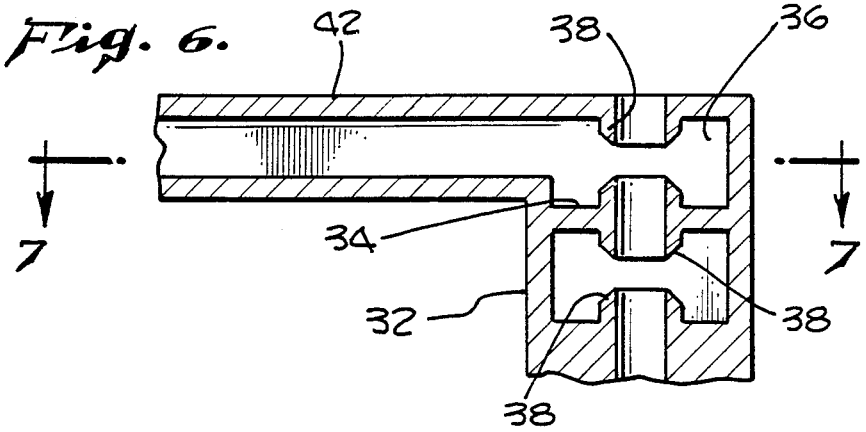
FIG. 6 is a cross-sectional view showing the cavities of a microwave electron tube similar to FIG. 3 with an output waveguide.
Figure 7:
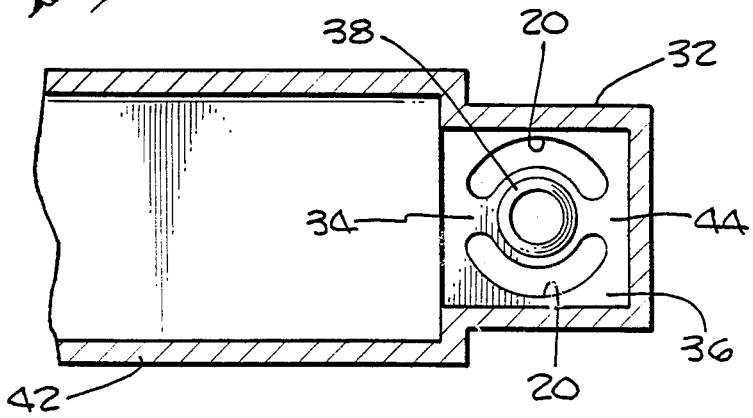
FIG. 7 is a cross-sectional view taken along line 7—7 of FIG. 6.

The present invention came about through evaluation of the foregoing comments and the circuit of FIG. 5 when evaluating the portion of a microwave electron tube shown in FIGS. 6 and 7. The cross-sectional view of FIG. 6 is similar to that of FIG. 3 except that a waveguide 42 has been added to the cavity 36. Further, the rectangular cavity plates 34 were provided with crescent shaped irises 20 (FIG. 7) such as those typically used in the cylindrical microwave electron tube 10 of FIG. 1. The device shown in FIGS. 6 and 7 is typically a tuned cavity output circuit which may be used on an extended interaction output circuit for a klystron. The microwave device shown in FIGS. 6 and 7 was, in fact, being used on the output circuit for cluster-cavity klystron, such as that shown in U.S. patent application Ser. No. 106,976, filed Oct. 1, 1987, (U.S. Pat. No. 4,800,322) entitled "Broadband Klystron Cavity Arrangement," by Robert S. Symons, assigned to the same assignee as the present invention. This application is a continuation of Ser. No. 663,801, filed Oct. 23, 1984, which is now abandoned.

While testing the rectangular cavity 36 with crescent shaped irises 20 of FIG. 7, it was realized that a narrow strip of copper 44 between the irises 20 in plate 34 was acting as an impedance and was limiting the coupling to the output waveguide 42. For these reasons, the inventors moved the irises towards the wall of cavity 36 away from the output window of waveguide 42 and opened up the area of the irises to retain as much inter-cavity coupling as possible. The results of this rearrangement of the iris cavities was unexpected. The rearrangement created an iris configuration with an unexpectedly high resonant frequency.

The preferred embodiment, shown in FIGS. 8 and 9, is the same microwave electron tube shown in FIGS. 6 and 7, except that generally triangular irises 50 have been placed in opposite corners of the rectangular cavity 36. It will be understood that what is meant by a generally triangular iris is that the iris 50 is moved into the corner of the rectangular cavity 36. The corners of the iris 50 are rounded and extend very close to one another at the point opposite from the output waveguide 42. It will be seen that the openings of irises 50 are generally rounded within the plate 34 at the area where they come closest to one another but are less rounded and, in fact, provided with a flat edge wall on opposite sides of the drift tube 38. One might describe the irises 50 as a right angle triangle having a hypotenuse which is rounded about the drift tube 38. Within this description, it will be understood that the generally triangular shape of irises 50 may or may not include corners having curved or straight edge portions within the corners opposite from the right angled corner of the triangle.

As stated above, the results obtained from the generally triangular irises 50 were unexpected. That is, the utilization of the generally triangular irises achieved the characteristic the inventors were seeking. The generally triangular irises 50 provided a high resonant frequency for the iris which was significantly higher than the resonant frequency of the cavity. By way of example only, the circuit shown in FIGS. 8 and 9 had an iris resonant frequency of 4.5 GHz in relation to the cavity resonance of 3.1 GHz. The resonant frequency of the iris $f_i$ was about 0.5 GHz higher than any frequency which had been previously achieved with crescent-shaped irises 20 or rectangular shaped irises 40. This higher resonant frequency for the iris has the advantage of providing an increased bandwidth and an increased impedance for the microwave electron tube circuit 10 in which it is used. Such higher iris frequency also reduces power losses between the coupled cavities.

The device shown in FIGS. 8 and 9 may be used in an extended interaction output circuit for a klystron, which typically has two to five cavities. The configuration of the coupled-cavity 36 with its generally triangular irises 50 arranged in adjacent corners of the rectangular cavity 36, as seen in FIG. 9, provides the desired high resonant frequency for the irises. Another advantage of the arrangement shown is that the increased amount of conductive material, such as copper in a klystron tube, next to the output window of cavity 36 which communicates with the output waveguide 42 helps to channel a high amount of energy or current out of the coupled cavity 36 and into the waveguide 42. This arrangement further helps in matching the interconnection between the cavity 36 and waveguide 42. Such matching is an important feature of the present invention.

It has been found that the same high resonant frequency, generally triangularly shaped irises 50 may be used in coupled-cavity, traveling-wave tubes having between five to thirty cavities. In such tubes, the generally triangularly shaped irises 50 may be used in one corner, opposite corners, adjacent corners, three corners or four corners of the rectangularly shaped cavities 36 as shown in FIGS. 10*a, b, c* and *d.*

It will be understood that the generally triangularly shaped irises may be used in a series of coupled cavities where the irises are in line, staggered, or arranged in any other geometric arrangement. Further, it will be understood that the rectangular cavity 36 may have any of several shapes, such as a triangle, pentagon, or any polygonal shapes. In such polygonal shapes, the irises are not necessarily triangular, but are located in the corners formed by the polygon.

We claim:

1. A microwave electron tube, having at least a pair of coupled cavities, comprising:

said coupled cavities having a polygonal shape with aligned sidewalls; and an iris for coupling said coupled cavities located in one corner of said polygonally shaped cavities.

2. A microwave electron tube, as claimed in claim 1, wherein:

said coupled polygonally shaped cavities include more than two cavities coupled by said irises; and a first iris is located in one corner of a first cavity and a second iris is located in a second corner of a second cavity staggered from the corner location of said first iris.

3. A microwave electron tube, as claimed in claim 1, wherein:

said coupled polygonally shaped cavities include more than two cavities coupled by said irises; and a first iris is located in one corner of a first cavity and a second iris is located in a second corner of a second cavity which is in line from the corner location of said first iris.

4. A microwave electron tube, as claimed in claim 1, wherein:

said polygonal shape is a rectangular shape; and said iris has a generally triangular shape with rounded corners located in one corner of said rectangularly shaped cavity.

5. A microwave electron tube, as claimed in claim 1, Wherein:

said iris is located in more than one corner of said polygonally shaped cavities.

6. A microwave electron tube, as claimed in claim 1, wherein:

said polygonal shape is a rectangular shape; and said iris has a generally triangular shape with rounded corners located in more than one corner of said rectangular cavity.

7. A microwave electron tube, as claimed in claim 6, wherein:

said iris is located in diagonally opposite corners of said rectangular cavity.

8. A microwave electron tube, as claimed in claim 6, wherein:

said iris is located in two adjacent corners of said rectangular cavity.

9. A microwave electron tube, as claimed in claim 6, wherein:

said iris is located in three corners of said rectangular cavity.

10. A microwave electron tube, as claimed in claim 6, wherein:

said iris is located in four corners of said rectangular cavity.

11. A microwave electron tube, as claimed in claim 1, wherein:

said tube is an extended interaction output circuit for a klystron having an output section;

said coupled cavities having said polygonal shape are located in said output section of said klystron.

12. A microwave electron tube, as claimed in claim 1, wherein:

said tube is a coupled-cavity, travelling-wave tube having sections; and said coupled cavities having said polygonal shape are located in one or more of said sections.

13. An extended interaction output circuit for a klystron having at least a pair of coupled cavities and an electron drift tube coupling said cavities, comprising:

said coupled cavities having a generally rectangular shape;

an iris-for coupling said coupled cavities located in one corner of said rectangular cavity; and said iris having a generally right triangular shape with rounded corners and a hypotenuse rounded about said drift tube.

14. An extended interaction output circuit for a klystron as claimed in claim 13, wherein:

said iris includes a pair of irises located in adjacent corners of said rectangular cavity.

15. An extended interaction output circuit for a klystron, as claimed in claim 14, additionally comprising:

an output waveguide connected to one of said cavities; and said irises in adjacent corners of said rectangular cavity to which said output waveguide connects are each arranged on the opposite side of said drift tube from said output waveguide.

16. An extended interaction output circuit for a klystron as claimed in claim 13, wherein:

said iris includes a pair of irises located in opposite diagonal corners of said rectangular cavity.

17. An extended interaction output circuit for a as claimed in claim 13, wherein:

said iris includes three irises.

18. An extended interaction output circuit for a klystron as claimed in claim 13, wherein:

said iris includes four irises.

19. A microwave electron tube, having at least a pair of coupled cavities, comprising:

said coupled cavities having a rectangular shape;

said coupled cavities having a centrally located aperture;

an iris for coupling said coupled cavities located in one corner of said rectangularly shaped cavity; and said iris having the general shape of a right angle triangle with a hypotenuse rounded about said aperture.

20. A microwave electron tube, having at least a pair of coupled cavities, comprising:

said coupled cavities having a rectangular shape;

said coupled cavities having a centrally located aperture;

an iris for coupling said coupled cavities, said iris having the general shape of a right angle triangle with a hypotenuse rounded about said aperture and with rounded corners; and said iris located in more than one corner of said rectangular cavity.

* * * * *